United States Patent [19]

Camphous

[11] Patent Number: 4,716,595

[45] Date of Patent: Jan. 5, 1988

[54] NECKTIE PROTECTOR

[76] Inventor: Dana L. Camphous, 41535 Clair Pointe, Mt. Clemens, Mich. 48045

[21] Appl. No.: 895,291

[22] Filed: Aug. 11, 1986

[51] Int. Cl.[4] ..... A41D 27/12

[52] U.S. Cl. ..... 2/46; 2/49 R

[58] Field of Search ..... 2/46, 49

[56] References Cited

U.S. PATENT DOCUMENTS

| | | | |
|---|---|---|---|
| 2,423,581 | 7/1947 | Clark | 2/46 X |
| 2,747,192 | 5/1956 | Katz | 2/46 |
| 2,830,297 | 4/1958 | Sabee | 2/49 R |
| 3,085,247 | 4/1963 | Bixby | 2/46 |
| 3,618,138 | 11/1971 | Retzkin | 2/46 |
| 3,714,669 | 2/1973 | Vorbau | 2/46 |
| 3,763,496 | 10/1973 | Miller | 2/46 |
| 3,833,937 | 9/1974 | Taylor | 2/46 |
| 4,453,273 | 6/1984 | Gerrick | 2/46 |

*Primary Examiner*—Louis K. Rimrodt

*Attorney, Agent, or Firm*—Harness, Dickey & Pierce

[57] ABSTRACT

A protector for neckties is disclosed. The protector includes a pair of elongated substantially identical and flat sheet members. The sheet members have a pair of longitudinal sides and at least a pair of lateral sides. The sheet members have a shape substantially corresponding to a necktie with a first and second end. The sheet members are positioned such that the longitudinal and lateral sides are in alignment and imposed upon one another. The sheet members are bonded together on one of the longitudinal and one of the lateral sides such that a necktie may be inserted into the protector between the sheet members through the non-bonded longitudinal and lateral sides. Also positioned on one of the sheet members is a securing member for securing at least one of the sheet members to the necktie.

1 Claim, 2 Drawing Figures

NECKTIE PROTECTOR

BACKGROUND AND SUMMARY OF THE INVENTION

The present invention relates to garment protectors and more particularly to a protector for neckties.

As the cost of neckties continues to escalate, it is important to protect them from spotting while dining. Generally, when food material drops onto a necktie, particularly silk neckties, general dry cleaning procedures, which ordinarily remove the spots from the necktie, have the tendency to cause the tie excessive wear if not totally destroying the tie.

In the past, several types of necktie protectors have been disclosed. They include:

U.S. Pat. No. 4,453,273, issued June 12, 1984, discloses a necktie protector comprised of a flat flexible envelope having two identical elongated plastic faces. The necktie protector is joined at the long edges and is not joined at the short edges thereof. Flat plastic tabs extend centrally from one of the short edges for securing the protector to the user.

U.S. Pat. No. 3,714,669, issued Feb. 6, 1973, discloses a one-piece panel shield in the form of a simulated, and preferably a little wider than the current widest style, four-in-hand tie. The protector, on its upper end, includes an attachment means in the form of lateral wing-like tabs carrying pressure-sensitive adhesive. The adhesive can be attached to the adjacent wing portion of the wearer's collar or to the knot of the tie, with the shield protectively overlying the tie.

U.S. Pat. No. 2,423,581, issued July 8, 1947, discloses a tie protector comprising a sheet of transparent water-repellent material. The protector has outwardly angulated lateral margins which are folded to overlap and securely detach to each other. The margins co-act with the medial portion of the protector sheet to form a sleeve. The protector has end portions folded and secured to the medial portion of the sheet, forming bights transverse to the axis of the sleeve. A strip of pliable metallic material extends through one of the bights. The strip has end portions adapted to be pressed into holding engagement with a garment.

U.S. Pat. No. 2,830,297, issued Apr. 15, 1958, discloses a protector comprising an outward sheet of absorbent material and a backing sheet of thermoplastic material. The sheet is formed to present at least one corner portion. An attaching tape is disposed across the formed corner of the side having the thermoplastic backing. The corner is folded over the tape and heat sealed in position to affix the tape onto the protector between the facing portions of the thermoplastic material.

U.S. Pat. No. 3,833,937, issued Sept. 10, 1974, discloses an attachable protective napkin for a man's tie which may be readily fastened to the tie so as to protect the tie, when being worn while eating, from the splatter of food or other liquids. The device is a shaped section of laminated absorbent and waterproof paper or plastic sheeting. One end of the tie napkin is triangular shaped so as to tuck about the tie and under the collar of the wearer. The napkin is shaped into the general outline of the man's tie and of slightly larger dimensions. The protector is fitted with flexible semi-rigid tie members that bend around the protected tie so as to retain the napkin in position.

Thus, the art has recognized that tie protectors serve a useful purpose for protecting ties from food splatter and spillage, however, the above art has several disadvantages. One of the disadvantages is that the tie protector must be pulled over the entire length of the tie, from the bottom up, and then tucked into the wearer's collar. Another disadvantage is several of the protectors have auxiliary fasteners, such as bendable members and tape members, for attaching the protector to the necktie. Another disadvantage is the necktie protector is formed from a rather rigid material which restricts movement of the wearer while dining. Thus, there is a need for a tie protector which will overcome the disadvantages of the above art.

Accordingly, it is an object of the present invention to overcome the disadvantages of the above art. The present invention provides the art with a necktie protector formed from flexible sheet members which are detachably attached to the wearer's tie or shirt without the use of auxiliary fasteners, such as bendable metallic members, tape, buttons, pins, or the like.

The new and improved necktie protector of the present invention includes a pair of elongated substantially flat flexible sheet members. The sheet members have a pair of longitudinal sides and a pair of lateral sides. The sheet members, having a first and second end and being substantially identical, have a shape substantially corresponding to a necktie. The sheet members are positioned such that the longitudinal and lateral sides are imposed upon one another. The sheet members are bonded together on one of the longitudinal and one of the adjacent lateral sides such that a necktie may be inserted between the sheet members through the non-bonded longitudinal and lateral sides. A securing member, positioned on at least one of the sheet members, secures the protector onto either the wearer's necktie or shirt, or both. Generally, the securing member is comprised of a releasable pressure sensitive adhesive which is positioned on the first or top end of the sheet members.

The sheet members may also have a second securing member positioned on the non-bonded longitudinal side for further enhancing securement of the necktie in the protector. Also, the second or bottom end of the protector, containing one of the lateral sides, may have a V-shape. In this case, the lateral side is divided into the two legs of the "V". One of the legs of the "V" is adjacent to the bonded longitudinal side of the sheet member. This leg is also bonded serving as the bonded lateral side forming the bonded longitudinal and lateral sides of the necktie protector.

From the following description and claims taken in conjunction with the accompanying drawings, other objects and advantages of the present invention will become apparent to one skilled in the art.

DESCRIPTION OF THE PREFERRED EMBODIMENT

Figure 1:
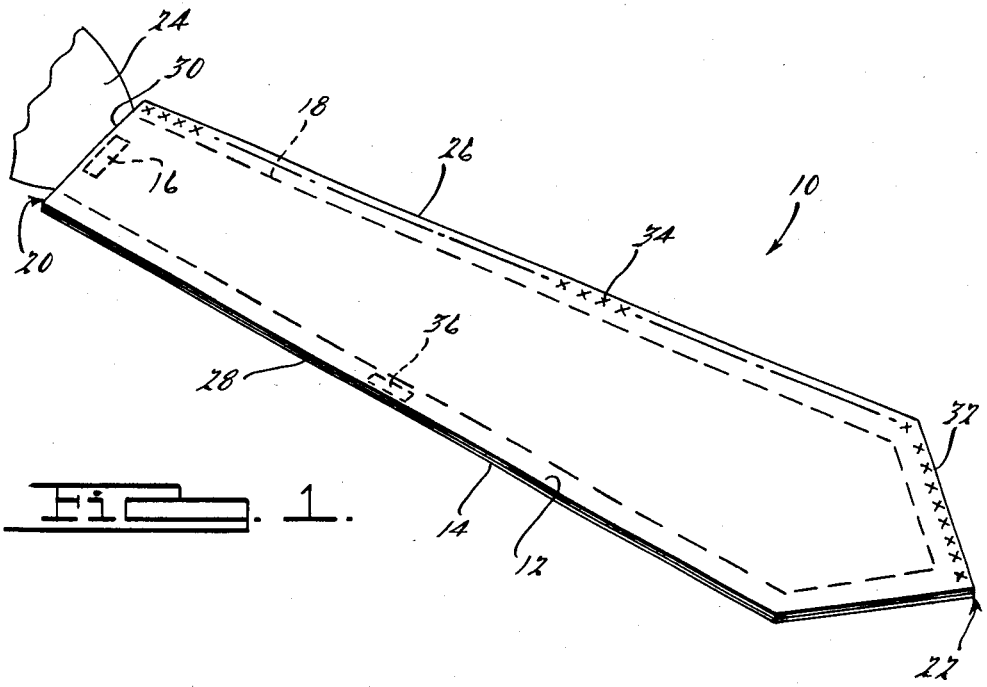
FIG. 1 is a plan view of a necktie protector in accordance with the present invention.
Figure 2:
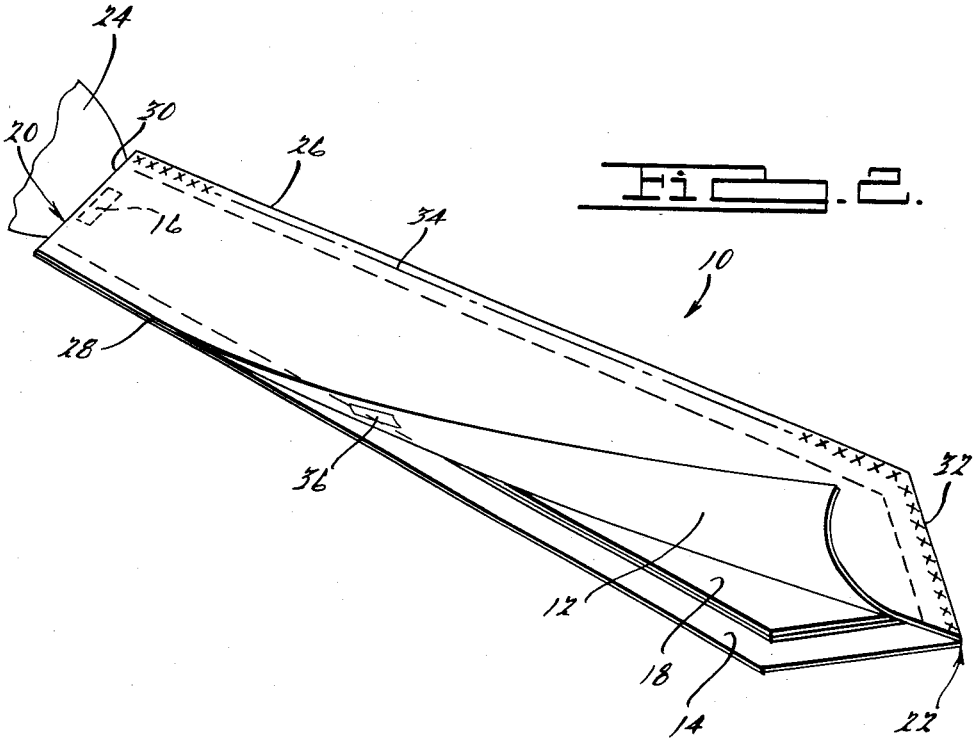
FIG. 2 is a side view of the necktie protector of FIG. 1.

Referring to FIGS. 1 and 2, a necktie protector is shown and designated with the reference numeral 10. The necktie protector 10 generally includes a pair of elongated, substantially flat, flexible sheet members 12 and 14. A securement member 16 is positioned on at least one of the sheet members 12 or 14 for securing the protector 10 onto a necktie 18.

Sheet members 12 and 14 have a shape substantially corresponding to a necktie and are substantially identical to one another. The sheet members are formed from a polymeric material having a thickness from approximately 50 to 125 and preferably 50 to 75 gage. The polymeric material may be selected from the group consisting of polyethylene and polypropylene, and preferably an untreated polyethylene plastic material. The material has an extremely low linear density and reduced static build-up.

The elongated sheet members 12 and 14 have a first 20 or top and a second 22 or bottom end. The first end 20 is generally somewhat narrower than the second end 22, which is wider corresponding to the bottom flaired end of the necktie 18. The first or top end 20 corresponds to the top end of the necktie, which is the end adjacent to the knot 24 of the necktie 18. The sheet members 12 and 14 have a pair of longitudinal sides 26 and 28. The longitudinal sides 26 and 28 have a length such that they will correspond and somewhat overlap a standard necktie 18. The sheet members 12 and 14 have lateral sides 30 and 32. The lateral side 30 is contained by the first or top end 20 and the second end 22 contains the other lateral side 32. Lateral side 32 has a V-shaped configuration conforming to the bottom flair end of the necktie 18.

The sheet members 12 and 14 are permanently bonded together by conventional means, such as adhesives, heat seal, and the like. The bond forms a characteristic bond line 34 along the bonded longitudinal and lateral sides 26 and 32. Generally, the sheet members 12 and 14 are bonded along a longitudinal side 26 and the adjacent V-leg of the lateral side 32. Thus, the sheet members 12 and 14 may be opened, as seen in FIG. 2, for insertion of the necktie 18 between the sheet members 12 and 14. The bond line 34 is positioned a desired distance from the longitudinal side 26 so that the line presents a pleasing aesthetic appearance. The other longitudinal side 28, V-leg of lateral side 32, and lateral side 30 are open and non-bonded.

The securement member 16 is positioned adjacent to the lateral side 30 of the sheet member 12. Generally, the securement member 16 is positioned on at least one of the sheet members 12 and 14. The securement member 16 is generally positioned on the top sheet member so that the securement member 16 may be adhered to the necktie 18. The securement member 16 is generally comprised of a releasable adhesive so that the securement member 16 may be temporarily affixed to the necktie 18 and then may be removed from the necktie for disposal.

A second securement member 36 may be positioned adjacent to the non-bonded longitudinal side 28 of the sheet members. The second securement member 36 further enhances securement of the necktie 18 between the sheet members 12 and 14. The second securement member 36 is positioned a predetermined distance from the first and second ends 20 and 22 such that the second securement member 36 is positioned approximately half-way between the first and second ends 20 and 22, however, the second securement member 36 may run the entire length of the longitudinal side 28. The second securement member 36 may be positioned such that the securement member 36 will contact both sheet members, securing the necktie 18 between the two sheet members 12 and 14. Also, the second securement member 36 may be positioned on the non-bonded longitudinal side 28 such that the securement member 36 adheres the sheet member to the necktie 18.

In an alternate embodiment, the lateral side 32 of the sheet members 12 and 14 may be a horizontal straight cut and not a V-shaped cut as shown in the drawings. In this case, the entire lateral edge would be bonded to secure the necktie between the sheet members 12 and 14. Also, the present invention may have a pleasing aesthetic design or indicia on the sheet members 12 and 14. Also, the sheet members 12 and 14 may be transparent enabling the aesthetic appearance of the necktie to radiate through the protector 10.

While the above summarizes the present invention, it will become apparent to those skilled in the art that modifications, variations, and alterations may be made without deviating from the scope and fair meaning of the subjoined claims.

What is claimed is:

1. A necktie protector comprising:

a pair of elongated substantially identical and flat sheet members, said sheet members formed from a transparent untreated polyethylene material having a low linear density, a reduced static build-up and a thickness of from about 50 to 75 gage, each of said sheet members having a pair of longitudinal sides and a pair of lateral sides, said lateral sides positioned adjacent to and between said longitudinal sides, said sheet members having a shape substantially corresponding to a necktie with a non-bonded first end and a second end, each of said ends having one of said lateral sides, said lateral side on said second end having an overall V-shape, each leg of said "V" being adjacent to one of said longitudinal sides, said sheet members being orientated with respect to one another such that said sheet members are imposed on one another, said sheet members being bonded together along only one of its longitudinal sides and only the adjacent leg of said second end V-shaped lateral side such that a necktie may be inserted into said protector through said non-bonded longitudinal and lateral sides;

a first releasable pressure sensitive adhesive means positioned adjacent to said non-bonded longitudinal side and between said lateral sides such that said first releasable adhesive means is at a substantially equal distance from said bonded lateral side and said non-bonded lateral side, said first releasable adhesive member adhering said first and second sheet members to one another to secure said tie within said tie protector; and a second releasable pressure sensitive adhesive means positioned adjacent to said first end non-bonded lateral side for securing said first and second sheet members to said tie to prevent axial movement of said tie protector along said tie.

* * * * *